US006655342B1

(12) United States Patent
Wendels et al.

(10) Patent No.: US 6,655,342 B1
(45) Date of Patent: Dec. 2, 2003

(54) PRE-LUBRICATION SYSTEM

(76) Inventors: Antonius G. Wendels, 2150 N. Beachwood Dr., #10, Los Angeles, CA (US) 90068; John W. Frencher, 1811 Tamarind St., #302, Hollywood, CA (US) 90028

( * ) Notice: Subject to any disclaimer, the term of this patent is extended or adjusted under 35 U.S.C. 154(b) by 0 days.

(21) Appl. No.: 10/125,831

(22) Filed: Apr. 18, 2002

Related U.S. Application Data

(60) Provisional application No. 60/284,257, filed on Apr. 18, 2001.

(51) Int. Cl.[7] ..... F01M 1/00
(52) U.S. Cl. ..... 123/196 R; 123/196 S
(58) Field of Search ..... 123/196 R, 196 S

(56) References Cited

U.S. PATENT DOCUMENTS 4,936,272 A * 6/1990 Whitmore ..... 123/196 S
5,000,143 A * 3/1991 Brown ..... 123/196 S
5,156,120 A * 10/1992 Kent ..... 123/196 S
5,511,522 A * 4/1996 Tran ..... 123/196 S
5,743,231 A * 4/1998 Reinosa ..... 123/196 S
6,349,692 B1 * 2/2002 Reinosa ..... 123/196 S

* cited by examiner

*Primary Examiner*—Tony M. Argenbright
*Assistant Examiner*—Katrina B. Harris
(74) *Attorney, Agent, or Firm*—Albert O. Cota

(57) ABSTRACT

A pre-lubrication system that lubricates a vehicle engine prior to starting the engine. The system operates manually or when an engine has low oil pressure resulting from operating the engine during slow moving traffic or during an oil pump failure. In its basic form, the system consists of a system starter that applies oil through a pre-lube oil pump, a check valve, a vehicle engine oil filter, a vehicle engine adapter connected to a vehicle engine/pan, and a vehicle battery that powers the system. The system can also include an electronic control unit and an AND gate that allows automatic operation of the system when an oil sensing switch senses a drop in oil pressure. Additionally, the system can be designed to include a battery trickle-charger, an engine warming subsystem and a battery warming subsystem.

13 Claims, 3 Drawing Sheets

PRE-LUBRICATION SYSTEM

This application claims priority of Provisional Application No. 60/284,257 with a file date of Apr. 18, 2001.

TECHNICAL FIELD

The invention pertains to the general field of mechanical devices, such as gasoline or diesel engines and, more particularly to a structure and method for pre-lubricating a device or engine before it is started.

BACKGROUND ART

Most vehicles, and especially trucks which are driven long distance for extended durations of time require their engines to be rebuilt after accumulating a certain amount of miles. To extend the rebuilding time the engine is often left running during rest stops or the like. This is due to the fact that the cost of fuel is considerably less than the wear that occurs from cold starting the engine, and because most of the wear and tear occurs during the initial engine starting. Many oil additives are available to help solve this problem, however a pre-lubrication system is considered to be the most effective method for reducing wear on the engine.

By pre-lubricating the engine before starting, metal-to-metal friction within the engine can be minimized, and a cost saving realized by not having to rebuild the engine due to failed or insufficient lubrication.

For the same reason, the engine of a truck that is stopped for a lunch break or the like can now be turned off, as the engine will be pre-lubricated before starting. This will save on fuel, thus lowering the cost of transporting goods and reduce pollution by not running a diesel or gasoline engine when it is stationary for an extended period.

A pre-examination search did not disclose any industry catalogs or publications as well as U.S. patents that read directly on the claims of the instant application.

DISCLOSURE OF THE INVENTION

The pre-lubrication system is designed to lubricate a mechanical device or a gasoline or diesel vehicle engine (hereinafter "engine") prior to starting the engine or after Periods of rest or no operation. By pre-lubricating the engine, the wear and tear on engine components which predominantly occurs when starting the engine is minimized, thus extending the useful life of the engine. The system can be started manually or automatically when the engine oil pressure reaches a pre-set low oil pressure. A low oil pressure can occur during extended periods of slow moving traffic, rest periods, or an oil pump malfunction/failure.

In its basic implementation, the pre-lubrication system functions in combination with a vehicle engine oil filter, a vehicle battery, and a vehicle engine that is modified by adding an input port and an output port. The system is comprised of a system starting means that is activated by the vehicle battery and that is followed sequentially by a pre-lube oil pump, a check valve, the vehicle engine oil filter, and a vehicle engine adapter that connects the system to the engine via the added engine input port. To complete the oil flow and oil circulation the added engine output port is connected to the pre-lube oil pump.

To enhance the utility of the invention the pre-lubrication system can be modified to include a battery trickle-charging subsystem, a vehicle engine warming subsystem, and a vehicle battery warming subsystem. All the subsystems are operational only when the vehicle engine is off.

The battery trickle-charging subsystem, which become operational when plugged into a utility power source, allows the battery to remain at full charge when the battery is connected to the system. The vehicle engine warming subsystem operate in combination with an engine heating element, that is enclosed within the engine pan, and a heating element thermostat. When the thermostat senses that the engine temperature has dropped to a pre-set detrimental level it close. This closure then allows the vehicle battery to energize the engine heating element which heats the engine for a pre-set time interval. The battery warming subsystem consists of a low-power vehicle battery heating element that is designed to be Positioned near or around the battery or the batteries surrounding structure. When the battery thermostat sense a pre-set drop in temperature, the thermostat closes which then allows the vehicle battery to power the battery heating element and heat the battery for a pre-set time interval.

In view of the above disclosure, the primary object of the invention is to produce a system that either manually or automatically pre-lubricate an engine prior to starting the engine or when the oil pressure drops below a preset detrimental level.

In addition to the primary object of the invention, it is also an object to produce a system that:

- by pre-lubricating the engine before starting minimizes the metal-to-metal friction wear and tear on the engine,
- prolongs the system the useful life of an engine,
- saves fuel by not operating a diesel or gasoline engine when a vehicle is parked for an extended period,
- is easily installed, and
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the pre-lubrication system (PLS) 10 is presented in terms of a preferred embodiment that is designed to be implemented in either a manual operating mode or in an automatic operating mode to which three subsystems can be added to enhance the utility of the PLS 10. In either mode of operation, the PLS 10 is designed to pre-lubricate a mechanical device having interfacing rotating or linear elements, a hybrid/electric engine, or a diesel or gasoline engine. For Purposes of disclosure and brevity, the discussion that follows will be limited to using the PLS 10 on a vehicle diesel or gasoline engine (hereinafter "engine")

By pre-lubricating an engine the wear and damage that can occur during the starting of the engine, after it has been off or after an extended idling period, can be prevented or at least minimized. The PLS 10 is also designed to function during operation of the engine under cold weather conditions and engines having low oil pressure resulting from operation during 510w moving traffic and/or an engine oil pump failure.

Figure 1:
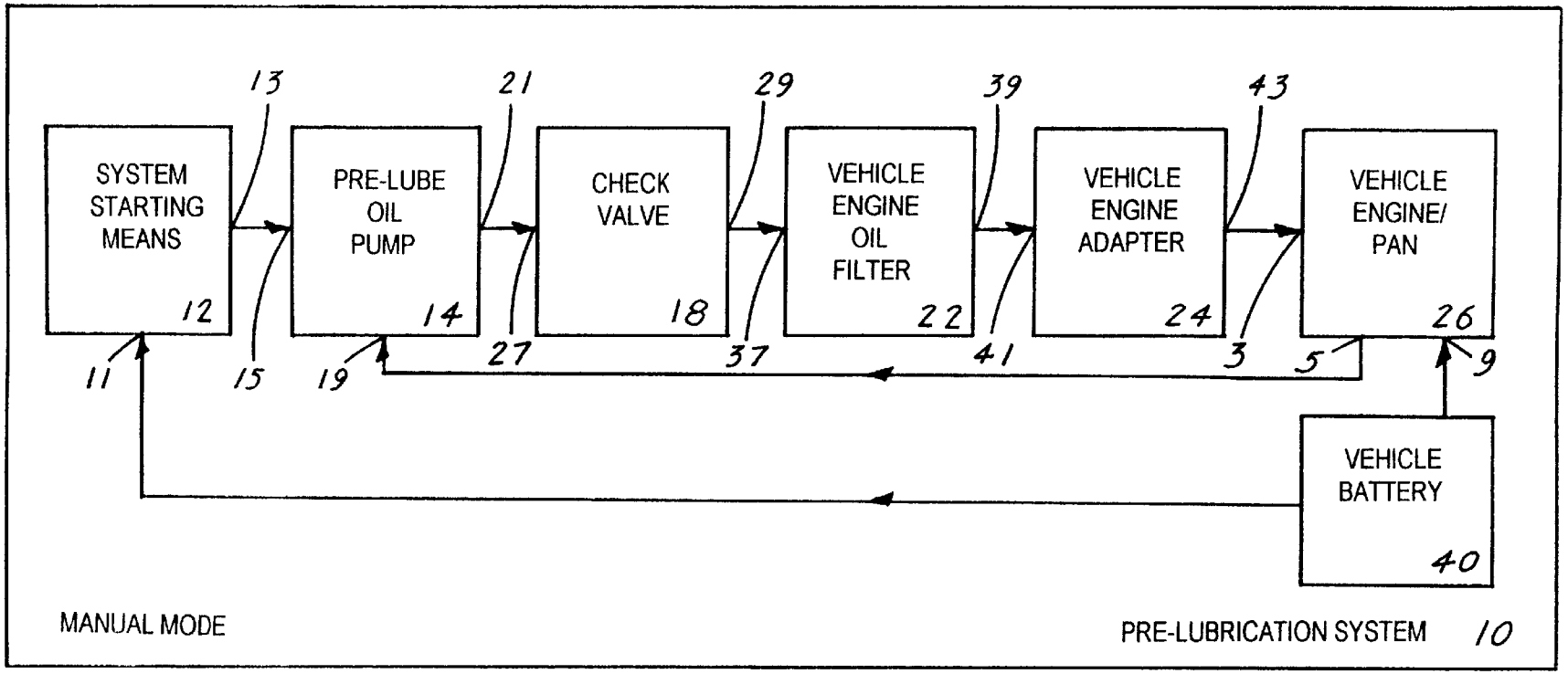
FIG. 1 is a block diagram showing the elements that are utilized when the system is operating in a manual mode.

In the manual mode of operation, as shown in FIG. 1, the PLS 10 is comprised of the following elements: a system starting means 12, a pre-lube oil pump 14, a check valve 18, a vehicle engine oil filter 22, a vehicle engine adapter 24, a vehicle engine/pan 26 and a vehicle battery 40.

To utilize the PLS 10 in the manual mode of operation, the oil pan of the vehicle engine 26 is modified by providing a first input port 3, a first output port 5 and an electrical Power input 9 that is internally connected to the electrical subsystem of the vehicle.

The system starting means 12 is activated when an input power signal 11 is applied from the vehicle battery 40. The starting means 12, which produces an output power signal 13, is preferably comprised of a conventional vehicle ignition switch that produces the output power signal when the ignition switch is placed in either the ON or the ACC position.

The pre-lube oil 14 pump, which is comprised of a high-pressure gear pump that delivers a pressure ranging from 10 to 40 psi, has a first electrical input 15, a first input port 19, and an output port 21. The first electrical input 15 is connected to the output power signal 13 from the system starting means 12, and the first input port 19 is connected to the first output port 5 on the vehicle engine/pan 26. The check valve, which follows the Pump 14, has an input port 27 that is connected to the output port 21 on the pre-lube oil 14 pump, and an output port 29 that is connected to the input port 37 on the vehicle engine oil filter 22.

The final element that is used to implement the manual mode is the vehicle engine adapter 24 which has an input port 41 connected to an output port 39 on the vehicle engine oil filter 22, and an output port 43 connected to the first input port 3 on the vehicle engine/pan 26.

In the manual mode of operation, the system starting means 12 applies 12-VDC to the pre-lube oil pump 14 which starts the pump 14. The pre-lube oil pump 14 is connected to an output on the vehicle engine 26, wherefrom the engine oil is applied to the pump 14. From the pump 14 the oil is pumped sequentially through the check valve 18, the vehicle engine oil filter 22, the vehicle engine adapter 24 and back into the vehicle engine 26.

Figure 2:
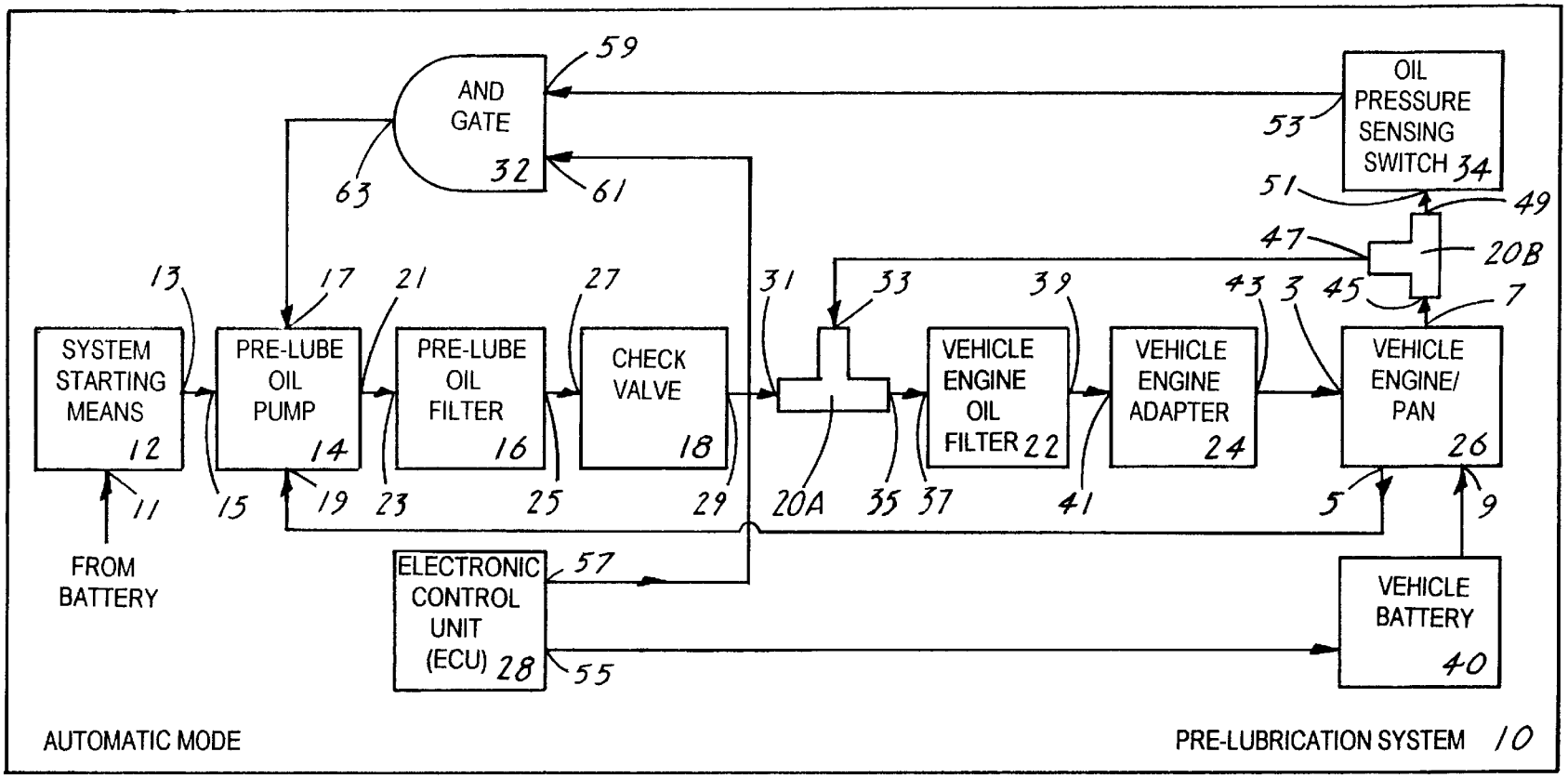
FIG. 2 is a block diagram showing the element that are utilized when the system is operating in an automatic mode.
Figure 3:
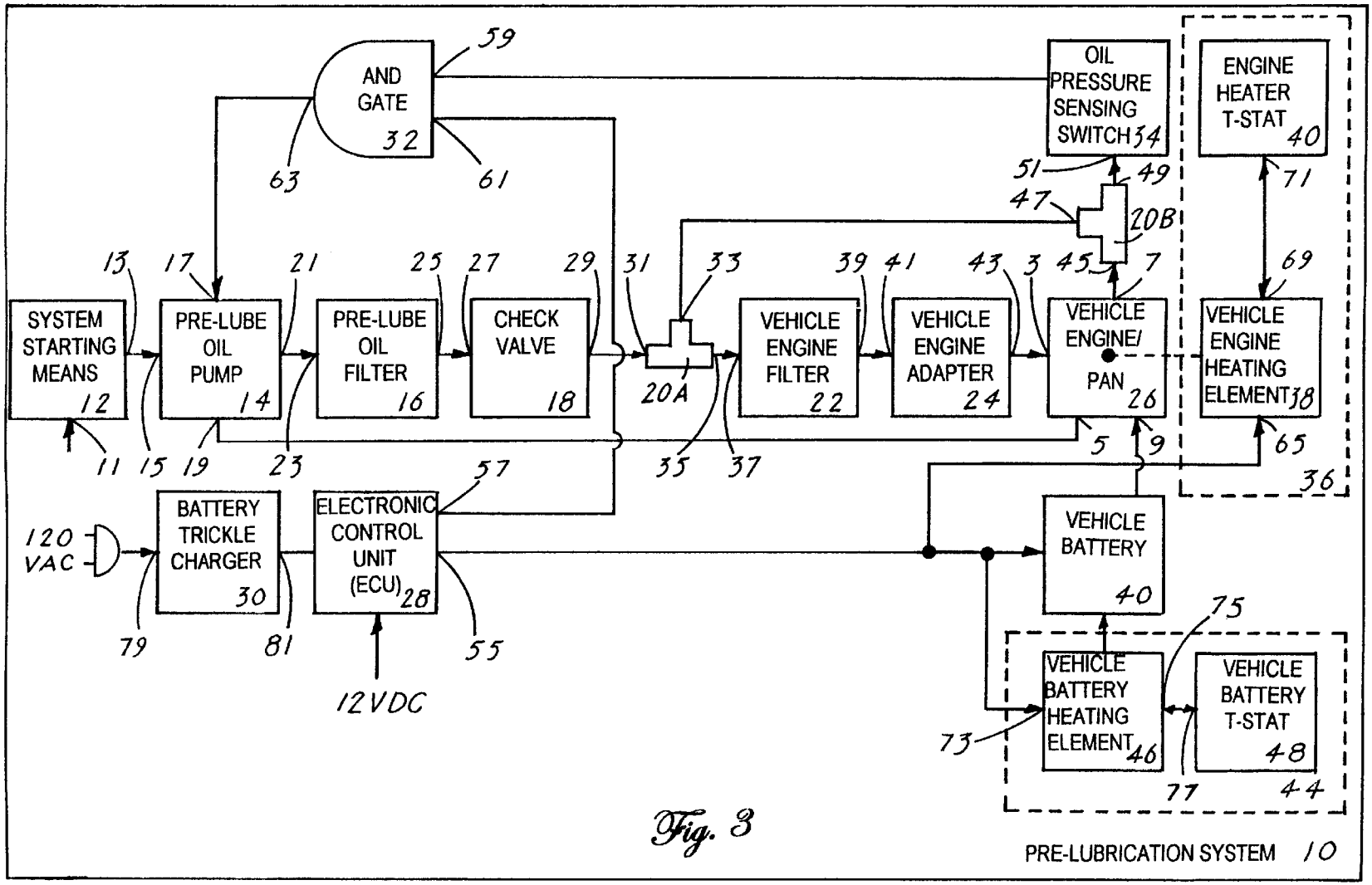
FIG. 3 is a block diagram showing the element utilized in the automatic mode and three additional subsystems that can be added to enhance the utility of the system.

In the automatic mode of operation, as shown in FIG. 2, the PLS 10 is comprised of the following elements: a system starting means 12, a pre-lube oil pump 14, a pre-lube oil filter 16, a check valve 18, a first T-connector 20A, a second T-connector 20B, a vehicle engine oil filter 24, a vehicle engine/pan 26, an AND gate 32, an oil pressure sensing switch 34, and a vehicle battery 40.

To utilize the PLS 10 in the automatic mode of operation, the oil pan of the vehicle engine 26 is modified by providing a first input port 3, a first output port 5 and an electrical power input 9 that is internally connected to the electrical subsystem of the vehicle.

The system starting means 12 is activated when an input power signal 11 is applied from the vehicle battery 40. The starting means 12, which produces an output power signal 13, is preferably comprised of a conventional vehicle ignition switch that produces the output power signal when the ignition switch is placed in either the on or the ACC position.

The pre-lube oil pump 14, which is comprised of a high-pressure gear pump that delivers a pressure ranging from 10 to 40 psi, has a first electrical input 15, a second electrical input 17, a first input port 19, and an output port 21. The first electrical input 15 is connected to the output Power signal 13 from the system starting means 12, and the first input port 19 is connected to the first output port 5 on the vehicle engine/pan 26.

From the output port 21, the pre-lube oil pump 14 is connected to the input port 23 on the pre-lube oil filter 16 which also has an output port 25. The pre-lube oil filter 16 is comprised of a cartridge containing a roll of tissue paper. Alternatively, the filter 16 can also be comprised of a cartridge filled with fine particles.

From the filter 16 the output port 25 is connected to an input port 27 located on the check valve 18, which prevents an oil backflow from entering the pre-lube oil filter 16. The output of the check valve is applied to the first T-connector 20A having a first input port 31, a second input port 33 and an output port 35. The first input port 31 is connected to the output port 29 on the check valve 18, and the output port 35 is connected to the input port 37 on the vehicle engine oil filter 22.

The vehicle engine adapter 24 has an input port 41 connected to the output Port 39 on the vehicle engine oil filter 22, and an output port 43 that is connected to the first input port 3 on the vehicle engine/pan 26. The output from the engine's second output port 7 is applied to a first input port 45 on the second T-connector 20B which also has a first output port 47 and a second output port 49. The first output port 47 is connected to the second input port 33 on the first T-connector 20A.

The oil pressure sensing switch 34 has an input port 51 and an electrical output 53. The input port 51 is connected to the second output port 49 on the second T-connector 20B.

The electronic control 28 unit has an output 55 and an output 57, wherein the output 55 is connected to the vehicle battery 40. The final element utilized in the automatic mode of operation is the AND gate 32 which has a first input 59 applied from the electrical output 53 of the oil pressure sensing switch 34, and a second enabling input 61 applied from the output 57 of the electronic control unit 28. The enabled gate produces an output that is applied to the second electrical input on the pre-lube oil pump.

The automatic mode of operation can also be designed to include three subsystems: a battery trickle-charging subsystem, a vehicle engine warming subsystem 36, and a vehicle battery warming subsystem 44.

The battery trickle-charging subsystem, which is operated when the vehicle engine is off, is comprised of: a battery trickle-charger 30 having an input 79 connected to a source of utility power and an output 81. The output is connected to and controlled by the electronic control unit (ECU). The utility power is typically comprised of 120-volts a-c.

The vehicle engine warming subsystem 36 is also operational When the vehicle engine 26 is off. The subsystem is comprised of a low-power, vehicle engine heating element 38 and an engine heater thermostat 40. The element 38 is located within the vehicle's oil pan and has a power input 65 and a power control input 69. The power input 65 is applied at pre-set intervals from a power output 55 produced by the electronic control unit (ECU). The engine heating-element thermostat 40 has an output 71 that is connected to the power control input 69 on the vehicle engine heating element 38. When the thermostat senses a detrimental pre-set drop in temperature, the thermostat closes, allowing the power input from the ECU 28 to be applied to and energize the vehicle engine heating element 38. The heating element 38, is preferably coated with polytetrafloridecthylene (PTSE) to insulate the heating element from the oil in the vehicle engine pan.

The final subsystem disclosed is the vehicle battery warming subsystem 44 that is also operational when the vehicle engine is off. The subsystem is comprised of a low-power, vehicle battery heating element 46 positioned adjacent the vehicle battery and having a power input 73 and a power control input 75. The power input 73 is applied at pre-set intervals from the power output 55 of the electronic control unit (ECU) 28, This subsystem also utilizes a vehicle battery thermostat 48 having an output connected to the power control input or the vehicle battery heating element. When the thermostat senses a pre-set drop in temperature, the thermostat closes. The closure allows the power input from the ECU 28 to be applied to and energize the vehicle battery heating element 46.

In the automatic mode of operation the electronic control unit (ECU) 28 and the oil pressure sensing switch 34 are operational. The ECU 28, which is connected to a 12-VDC power source, has an input connected to the output of the battery trickle-charger 30, which has an input connected to a 120-VAC utility power source. The battery trickle-charge 30 provides a lower charging current to the vehicle battery 40 to maintain the battery's starting current at full power.

The ECU 28 operates an integral electronic relay having a pole connected to a 12-VDC power source, and a first contact and a second contact. The relay is time sequenced to provide a system ON period selectable from 10 to 40 seconds and a system OFF period selectable from 20 to 40 minutes. During the ON period the relay is positioned to cause the ECU 28 to provide a logic 1 signal to the input 61 on the AND gate 32. When the oil pressure sensing switch 34 senses a drop in engine oil pressure, which can result during slow moving traffic and/or an engine oil pump failure, a second logic 1 signal is produced and applied to input 59 on the AND gate 32. The application of the logic 1 signals from both the ECU 28 and the oil pressure sensing switch 34 enables and causes the AND gate to produce an output signal 63 which is applied to the pre-lube oil pump 14. The output signal 63 activates the pre-lube oil pump 14 and allows oil to flow to the vehicle engine 26.

The vehicle engine/pan 26 is maintained at a warm temperature by means of the low-power, vehicle engine heating element 38 and the engine heater thermostat 40. The heating element 38 has a first input connected to 12-VDC that is derived from the output signal 55 from the ECU 28. When the engine heater thermostat 40 senses a drop in temperature it closes, which allows the 12-VDC output from the ECU to be applied to and energize the vehicle heating element 38 for a pre-selected time period set into the ECU 28. The heating element 38 keeps the engine oil from becoming too heavy to pump during an engine startup, thus placing less stress on the starting system. The warmed oil is Pumped to the upper section of the vehicle engine to keep the engine lubricated and from forming frost on the engine parts.

The vehicle battery 40 is likewise maintained at a warm temperature by utilizing the vehicle battery heating element 46 and the vehicle battery thermostat 48. The vehicle battery 40 has an input to which is applied 12-VDC that is derived from the output signal 55 on the ECU 28, and an input 73 connected to the vehicle battery heating element 46 which is connected to the output of the vehicle battery thermostat 40. When the thermostat 48 senses a below normal temperature it closes, which then allows the 12-VDC input from the ECU to be applied to and energize the vehicle battery heating element 46. The heating element heats the battery for a pre-selected time period set into the ECU 28.

When the PLS 10 is not operational, the oil from the vehicle engine/pan 26 is applied sequentially through the T-connector 20B, the T-connector 20A, the vehicle engine filter 22, the vehicle engine adapter 24 and back into the vehicle engine 26. During this normal oil flow, the check valve 18 prevents oil flow from entering the pre-lube oil filter 16.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

What is claimed is:

1. A pre-lubrication system that functions in combination with a vehicle engine, a vehicle engine oil filter having an input port and an output port, and a vehicle battery. said system comprising:

a) said vehicle engine incorporating an oil pan that is modified by providing a first input port, a first output port and an electrical power input that is internally connected to the electrical subsystem of said vehicle, b) a system starting means that when activated by an input power signal applied from said vehicle battery produces an output power signal, c) a pre-lube oil pump having a first electrical input, a first input port, and an output port, wherein the first electrical input is connected to the output power signal from said system starting means, and the first input port is connected to the first output port on said vehicle engine, d) a check valve having an input port connected to the output port on said pre-lube oil pump, and an output port connected to the input port on said vehicle engine oil filter, and e) a vehicle engine adapter having an input port connected to the output port on said vehicle engine oil filter, and an output port connected to the first input port on said vehicle engine, wherein said system functions by applying the oil from said vehicle engine through said system and recirculating the oil back into the vehicle engine to maintain said vehicle engine in a lubricated condition prior to starting said vehicle engine.

2. The system as specified in claim 1 wherein said system starting means is comprised of a conventional vehicle ignition switch that produces the output power signal when said ignition switch is placed in either the ON or the ACC position.

3. The system as specified in claim 1 wherein said pre-lube oil pump is comprised of a high-pressure gear pump.

4. The system as specified in claim 3 wherein said pre-lube oil filter delivers a pressure ranging from 10 to 40 psi.

5. The system as specified in claim 1 wherein said pre-lube oil filter is comprised of a cartridge filled with fine particles.

6. An pre-lubrication system that functions in combination with a vehicle engine, a vehicle engine oil filter having an input port and an output port and a vehicle battery, said system comprising:

a) said vehicle engine incorporating an oil pan that is modified by providing a first input port, a first output port, a second output port, and an electrical power input that is internally connected to the electrical subsystem of said vehicle, b) a system starting means that when activated by an input power signal applied from said vehicle battery produces an output power signal, c) a pre-lube oil pump having a first electrical input, a second electrical input, a first input port, and an output port, wherein the first electrical input is connected to the output power signal from said system starting means, and the first input port is connected to the first output port on said vehicle engine, d) a pre-lube oil filter having an input port and an output port, wherein the inlet port is connected to the output port on said pre-lube oil pump, e) a check valve having an input port and an output port, wherein the input port is connected to the output port on said pre-lube oil filter, f) a first T-connector having a first input port, a second input port and an output port, wherein the first input port is connected to the output port on said check valve, and the output port is connected to the input port on said vehicle engine oil filter, g) a vehicle engine adapter having an input port connected to the output port on said vehicle engine oil filter, and an output port connected to the first input port on said vehicle engine, h) a second T-connector having a first input port, a first output port and a second output port, wherein the first input port is connected to the second output port on said engine, and the first output port is connected to the second input port on said first T-connector, i) an oil pressure sensing switch having an input port, and an electrical output, wherein the input port is connected to the second output port on said second T-connector, j) an electronic control unit having an input and an output, wherein the input is connected to said vehicle battery, and k) an AND gate having a first input applied from the electrical output of said oil pressure sensing switch, and a second enabling input applied from the output of said electronic control unit, wherein the enabled gate produces an output signal that is applied to the second electrical input on said pre-lube oil pump, wherein said system automatically maintains said vehicle engine in a lubricated condition prior to a starting said engine or if low oil pressure is sensed.

7. The system as specified in claim 6 further comprising a battery trickle-charging subsystem that is operational when said vehicle engine is off, said subsystem comprising: a battery trickle-charger having an input connected to a source of utility power and an output connected to and controlled by said electronic control unit (ECU).

8. The system as specified in claim 7 wherein said utility power is comprised of 120-volts a-c.

9. The system as specified in claim 8 further comprising a vehicle engine warming subsystem that is operational when said vehicle engine is off, said subsystem comprising:

a) a low-power, vehicle engine heating element located within the oil pan and having a power input and a power control input, wherein the power input is applied at pre-set intervals from the power output produced by said electronic control unit (ECU), and b) an engine heating-element thermostat having an output that is connected to said vehicle engine heating element, wherein when said thermostat senses a pre-set drop in temperature, the thermostat closes, allowing the power input from said ECU to be applied to and energize said vehicle engine heating element.

10. The system as specified in claim 9 wherein said heating element is coated with polytetrafloridecthylene (PTSE) to insulate said heating element from the oil in the vehicle engine pan.

11. The system as specified in claim 8 further comprising a vehicle battery warming subsystem that is operational when said vehicle engine is off, said subsystem comprising:

a) a low-power vehicle battery heating element positioned adjacent said vehicle battery and having a power input and a power control input, wherein the power input is applied at pre-set intervals from the power output of said electronic control unit (ECU), and b) a vehicle battery thermostat having an output connected to said vehicle battery heating element, wherein when said thermostat senses a pre-set drop in temperature, the thermostat closes, allowing the power input from said ECU to be applied to and energize said vehicle battery heating element.

12. The system as specified in claim 11 wherein said vehicle battery heating element is comprised of a resilient band that is placed around said vehicle battery or the structure surrounding said vehicle battery.

13. A pre-lubrication system that functions in combination with a vehicle battery said system having means for circulating oil through the, vehicle engine when the vehicle engine is turned off or when the vehicle engine is running with a detrimental low oil pressure, wherein said means for circulating oil through the vehicle engine when the vehicle engine is turned off comprises a battery trickle-charger that, when connected to a source of utility power maintains the vehicle battery in a charged condition wherein said battery energizes and allows a system starting means to activate a pre-lube oil pump which is connected to and pumps oil into the vehicle engine.

* * * * *